US008395576B2

(12) United States Patent
Huh

(10) Patent No.: US 8,395,576 B2
(45) Date of Patent: Mar. 12, 2013

(54) ORGANIC ELECTRO-LUMINESCENCE DEVICE AND METHOD OF DRIVING THE SAME

(75) Inventor: Jin Huh, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 87 days.

(21) Appl. No.: 12/879,870

(22) Filed: Sep. 10, 2010

(65) Prior Publication Data

US 2010/0328276 A1 Dec. 30, 2010

Related U.S. Application Data

(62) Division of application No. 11/319,564, filed on Dec. 29, 2005, now abandoned.

(30) Foreign Application Priority Data

Dec. 31, 2004 (KR) ..... 2004-118385

(51) Int. Cl.
*G09G 3/30* (2006.01)
*G09G 3/36* (2006.01)

(52) U.S. Cl. ..... 345/92; 345/76

(58) Field of Classification Search ..... 345/76–83, 345/36, 39, 44–46, 92; 315/169.3; 313/463, 313/504

See application file for complete search history.

(56) References Cited

U.S. PATENT DOCUMENTS

| | | | | |
|---|---|---|---|---|
| 6,909,242 | B2 * | 6/2005 | Kimura | 315/169.3 |
| 6,999,048 | B2 | 2/2006 | Sun et al. | 345/82 |
| 7,173,585 | B2 | 2/2007 | Weng | 345/82 |
| 7,283,108 | B2 | 10/2007 | Kasai | 345/76 |
| 7,292,210 | B2 | 11/2007 | Sun | 345/82 |
| 7,315,292 | B2 * | 1/2008 | Yamashita | 345/82 |
| 7,446,739 | B2 | 11/2008 | Nakanishi et al. | 345/76 |

* cited by examiner

*Primary Examiner* — Jimmy H Nguyen
(74) *Attorney, Agent, or Firm* — Morgan, Lewis & Bockius LLP

(57) ABSTRACT

An organic electro-luminescence device includes a drive unit having first to fourth transistors and a capacitor, and an organic light emitting diode (OLED) controlled by the drive unit, wherein the first transistor has its gate, drain and source connected to a first node, a second node and a power voltage supply line, respectively; the second transistor has its drain and source connected to the OLED and the second node, respectively; the third transistor has its gate, drain and source connected to a first select signal line, the second node and the first node, respectively; the fourth transistor has its gate, drain and source connected to the first select signal line, a data line, and the second node, respectively; and the capacitor is connected to the first node and a predetermined signal line.

4 Claims, 6 Drawing Sheets

ORGANIC ELECTRO-LUMINESCENCE DEVICE AND METHOD OF DRIVING THE SAME

The present invention is a divisional application of application Ser. No. 11/319,564, filed on Dec. 29, 2005, now abandoned which claims the benefit of Korean Patent Application No. 2004-118385 filed in Korea on Dec. 31, 2004, both of which are hereby incorporated by reference.

BACKGROUND OF THE INVENTION

1. Field of the Invention

The present invention relates to an organic electro-luminescence device, and more particularly, to an organic electro-luminescence device capable of improving image quality and a method of driving the same.

2. Background of the Related Art

There are various kinds of flat panel displays that have been recently developed to substitute heavy and bulky cathode ray tubes (CRTs). Examples of these flat panel displays are a liquid crystal display (LCD), a field emission display (FED), a plasma display panel (PDP), an electro-luminescence display (ELD), etc. Much effort has been made to improve image quality and enlarge screen sizes of the flat panel displays. Among those flat panel displays, the organic electro-luminescence device has attracted considerable attention as a self-luminous display device that emits light by itself. The organic electro-luminescence device displays a predetermined image by recombining electrons and holes. Moreover, the organic electro-luminescence device is driven at a low direct current (DC) voltage and has a high response speed.

FIG. 1 is a circuit diagram illustrating a unit pixel according to the related art. One pixel in the organic electro-luminescence device with N×M pixels is illustrated as representative. As shown in FIG. 1, a current drive transistor M2 is connected to an organic light emitting diode (OLED) so that the current drive transistor M2 supplies a drive current to the OLED to emit light. The amount of the drive current from the current drive transistor M2 is determined by a data voltage Vdata applied through a switching transistor M1. The switching transistor M1 has its gate, source and drain connected to a select signal line 2, a data line 4 and the current drive transistor M2, respectively.

A capacitor Cst is connected between a source and a gate of the current drive transistor M2 to maintain the applied data voltage Vdata during a predetermined interval. Upon operations of pixels, the switching transistor M1 is turned on by a select signal from the select signal line 2, and then the data voltage Vdata is applied to a gate of the current drive transistor M2 through the data line 4. The OLED emits light when receiving a drive current generated according to the data voltage Vdata applied to the gate of the current drive transistor M2. The drive current flowing through the OLED is expressed in an Equation 1.

$$(I_{OLED}) = \frac{\beta}{2}(V_{dd} - V_{data} - |V_{th}|)^2 = \frac{\beta}{2}(V_{gs} - V_{th})^2 \qquad \text{(Equation 1)}$$

wherein $I_{OLED}$ represents the drive current flowing through the OLED, $V_{dd}$ represents the drive voltage, and $V_{gs}$, $V_{th}$, $V_{data}$ and β represent a voltage between the source and the gate of the current drive transistor M2, a threshold voltage of the current drive transistor M2, a data voltage, and a constant value, respectively.

As illustrated in Equation 1, the drive current $I_{OLED}$ is supplied to the OLED according to the data voltage Vdata, and brightness of the OLED is determined by an intensity of the applied drive current $I_{OLED}$. Meanwhile, the drive voltage Vdd is supplied through a power voltage supply line 6. The power voltage supply line 6 is connected to the current drive transistor M2. The power voltage supply lines may be formed in horizontal lines and vertical lines in order to be disposed on all pixels of the organic electro-luminescence device. Herein, when the drive voltage Vdd is supplied through an original line resistance in the power voltage supply line 6, a drop voltage is generated as the drive voltage Vdd flows through the power voltage supply line 6. Accordingly, as illustrated in FIG. 2, the power voltage supply line 6 in the left side of the organic electro-luminescence device is disposed far from a power voltage supply line 6' in the right side of the organic electro-luminescence device, thereby generating a difference of the drive voltage therebetween. That is, the drive voltage Vdd flowing in the right power voltage supply line 6' is smaller than that supplied to the left power voltage supply line 6. Accordingly, as illustrated in Equation 1, the drive voltage of each pixel depends on the data voltage Vdata when the drive voltage Vdd has a fixed constant value. In this case, brightness of the OLED in each pixel is controlled by a change in the data voltage Vdata.

However, as described above, when the constant data voltage Vdata is supplied to all pixels to obtain an identical gray scale, the drive current in each pixel becomes different because the drive voltage Vdd supplied to each pixel becomes different. Accordingly, a constant gray scale cannot be obtained due to the occurrence of a brightness difference between the pixels. On the other hand, although the voltage $V_{gs}$ between the source and the gate of the current drive transistor M2 is identical, a deviation is generated in the threshold voltage $V_{th}$ due to a non-uniformity of manufacturing processes. Thus, the amount of current supplied to the OLED becomes different, thereby causing different luminous brightness. Moreover, since a unit pixel with the same structure is formed on the entire region of the panel, characteristics of the current drive transistor M2 fluctuate according to pixel positions. As a result, there is a limitation in an optimized gray scale realization due to a brightness difference between the pixels.

There is an advantage in that the current drive pixel structure can compensate for the characteristic fluctuations of the device, and a voltage drop of the power voltage supply line. However, when resistance and capacitance of the data line increases, it is difficult to display a low gray level due to charging and discharging of the data line.

SUMMARY OF THE INVENTION

Accordingly, the present invention is directed to an organic electro-luminescence device and a method of driving the same that substantially obviate one or more problems due to limitations and disadvantages of the related art.

An object of the present invention is to provide a pixel structure capable of compensating itself, and to provide an organic electro-luminescence device capable of improving an expression ability of a low gray scale and a method of driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an organic electro-luminescence device including a drive unit having first to fourth transistors and capacitor, and an OLED (organic light emitting diode) to emit light under control of the drive unit, wherein the first transistor has a gate, a drain and a source connected to a first node, a second node and a power voltage supply line, respectively; the second transistor has a drain and a source connected to the OLED and the second node, respectively; the third transistor has a gate, a drain and a source connected to a first select signal line, the second node and the first node, respectively; the fourth transistor has a gate, a drain and a source connected to the first select signal line, a data line and the second node, respectively; and the capacitor is connected to the first node and a predetermined signal line.

In another aspect of the present invention, there is provided a method of driving an organic electro-luminescence device including a drive unit having first to fourth transistors and capacitor, and an OLED (organic light emitting diode) to emit light under control of the drive unit, wherein the first transistor has a gate, a drain and a source connected to a first node, a second node and a power voltage supply line, respectively; the second transistor has a drain and a source connected to the OLED and the second node, respectively; the third transistor has a gate, a drain and a source connected to a select signal line, the second node and the first node, respectively; the fourth transistor has a gate, a drain and a source connected to the select signal line, a data line and the second node, respectively; and the capacitor is connected to the first node and a predetermined signal line. The method includes charging a voltage corresponding to a data current supplied to the data line in the first node during a first period and emitting light from the OLED in response to a drive current proportional to a changed voltage when the voltage corresponding to the data current is changed by a signal applied to the predetermined signal line during second period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
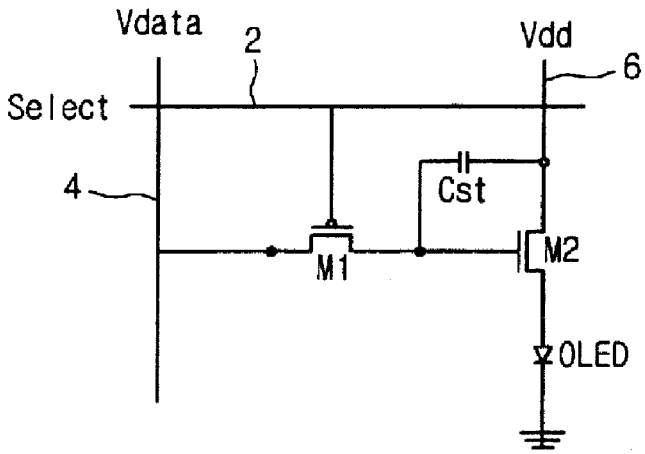
Fig.1 (Related Art)
FIG. 1 is a circuit diagram illustrating a unit pixel according to the related art.
Figure 2:
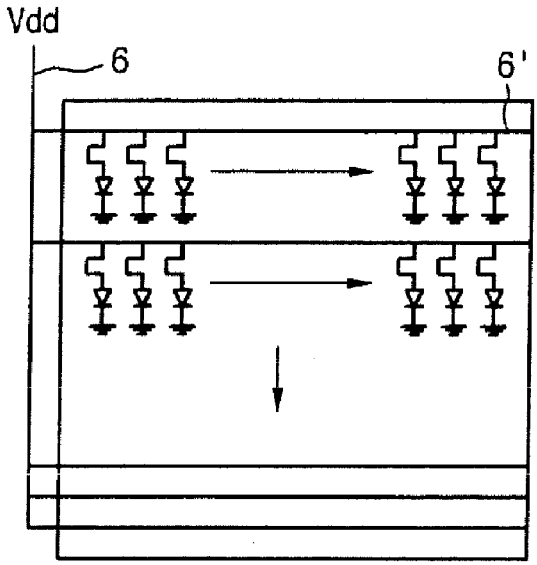
Fig.2 (Related Art)
FIG. 2 is a circuit diagram illustrating an organic electro-luminescence device with the unit pixel of FIG. 1 arranged in a matrix form.
Figure 3:
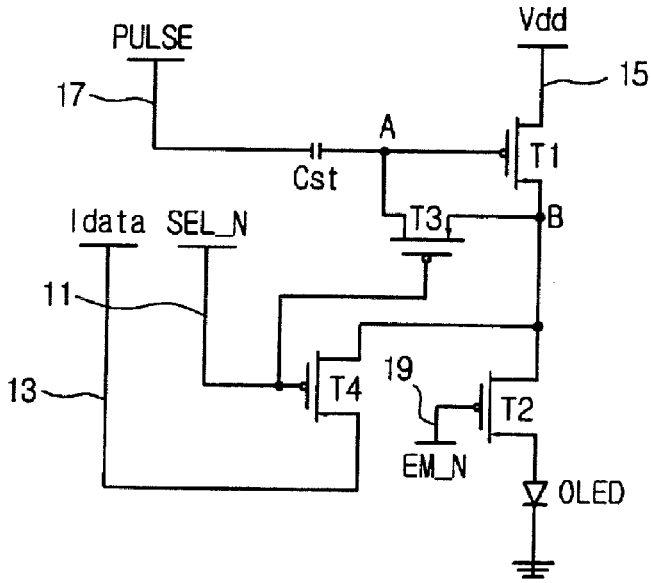
FIG. 3 is a circuit diagram illustrating a unit pixel according to a first exemplary embodiment of the present invention.

FIG. 3 is a circuit diagram illustrating a unit pixel according to a first exemplary embodiment of the present invention. As illustrated in FIG. 3, the unit pixel includes a drive unit and an OLED connected to the drive unit. The drive unit is provided with first to fourth transistors T1 to T4 and a capacitor Cst. The first to fourth transistors T1 to T4 may be PMOS transistors that are turned on by a low signal and turned off by a high signal. The first transistor T1 is a current drive transistor. The second to fourth transistors T2 to T4 are switching transistors. Also, the first to fourth transistors T1 to T4 may be NMOS transistors that are driven by a signal with a phase inversed to that of a signal supplied to a gate of the PMOS transistor.

The first transistor T1 is connected to a power voltage line 15. The second transistor T2 is arranged between the first transistor T1 and the OLED. The third and fourth transistors T3 and T4 are connected to a select signal line 11 and a gate. Specifically, the first transistor T1 includes a gate, a drain and a source that are connected to a first node A, a second node B and the power voltage supply line 15, respectively. The second transistor T2 includes a gate, a drain and a source that are connected to a pixel select signal line 19, the OLED and the second node B, respectively. The third transistor T3 includes a gate, a drain and a source that are connected to the select signal line 11, the second node B and the first node A, respectively. The fourth transistor T4 includes a gate, a drain and a source that are connected to the select signal line 11, a data line 13 and the second node B, respectively. A data current Idata is supplied to the data line 13. The capacitor Cst is disposed between a pulse supply line PULSE and the first node A.

Figure 4:
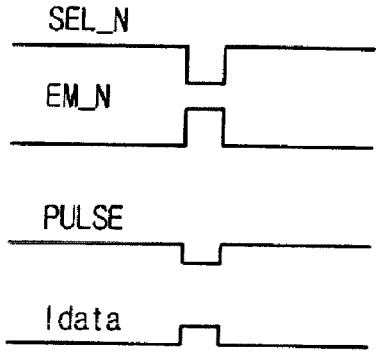
FIG. 4 is a timing diagram illustrating the unit pixel of FIG. 3.

FIG. 4 is a timing diagram illustrating the unit pixel of FIG. 3. As shown in FIG. 4, during operations of the unit pixel, the third and fourth transistors T3 and T4 are turned on by a low select signal SEL_N supplied to the select signal line 11, and the second transistor T2 is turned off by a high pixel select signal EM_N supplied to the pixel select signal line 19. In this exemplary first embodiment, the data current Idata supplied to the data line 13 flows in the first transistor T1 through the fourth transistor T4 and the second node B, thereby charging a drive voltage corresponding to the data current Idata in the gate of the first transistor T1, namely, the first node A. At this point, a difference value between the drive voltage and the pulse signal is stored in the capacitor Cst. When the pixel select signal EM_N is in a high state, the second transistor T2 is not turned on, and therefore no current flows in the OLED. When the select signal SEL_N is changed to a high state while the pixel select signal EM_N is changed to a low state, the third and fourth transistors T3 and T4 are turned off.

In this exemplary embodiment, a drive current flows in the first transistor T1 by a voltage (a difference value between a drive voltage and a pulse signal) charged to the storage capacitor Cst. When the pixel select signal EM_N is a low state and the second transistor T2 is turned on, the drive current generated from the first transistor T2 is directly supplied to the OLED to emit light. At this point, the drive current has a current value generated in proportion to a voltage charged in the storage capacitor Cst. However, when the pulse signal PULSE is changed, the voltage (a difference valued between the drive voltage and the pulse signal) charged in the storage capacitor Cst is also changed by the pulse signal PULSE, thereby changing the drive current. For example, when the pulse signal is changed from a low state to a high state, the drive voltage charged in the first node A increases as much as the increased pulse signal. The drive current flowing in the first transistor T1 becomes smaller than the data current Idata by the increased drive voltage. The brightness of the OLED decreases more by the drive current that is smaller than the data current Idata. Accordingly, a gray scale determined by the data current Idata can be changed by controlling the pulse signal PULSE, thereby easily expressing a low gray scale. In addition, a pulse width of the pulse signal PULSE may be designed differently according to a circuit configuration and a data line load. The gate of the second transistor T2 may be connected to the select signal line 11. In this exemplary embodiment, the second transistor T2 has a polarity opposite to that of the third and fourth transistors T3 and T4.

Figure 5:
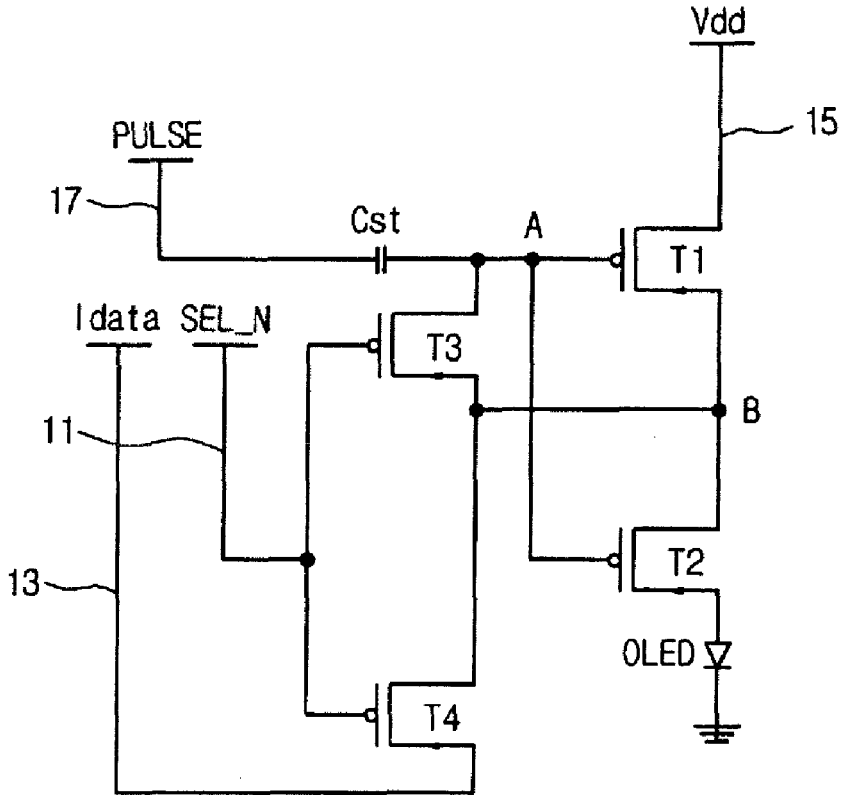
FIG. 5 is a circuit diagram illustrating a unit pixel according to a second exemplary embodiment of the present invention.

FIG. 5 is a circuit diagram illustrating to a unit pixel according to a second exemplary embodiment of the present invention. As illustrated in FIG. 5, the unit pixel includes a drive unit and an OLED connected to the drive unit. The drive unit is provided with first to fourth transistors T1 to T4 and a capacitor Cst. The unit pixel in this second exemplary embodiment is similar to the unit pixel of FIG. 3. The unit pixel of FIG. 3 includes the first transistor T1 having its gate connected to the first node A and the second transistor T2 having its gate connected to the pixel select signal line EM_N. Unlike the first exemplary embodiment, the unit pixel of FIG. 5 includes the first and second transistors T1 and T2 that have their gates both connected to the first node A. That is, the first and second transistors T1 and T2 are simultaneously connected to the first node A. Moreover, the second transistor T2 is turned off when the third and fourth transistors T3 and T4 are turned on by the select signal SEL_N of a low state, whereas the second transistor T2 is turned on when the third and fourth transistors T3 and T4 are turned off by the select signal SEL_N of a high state.

Figure 6:
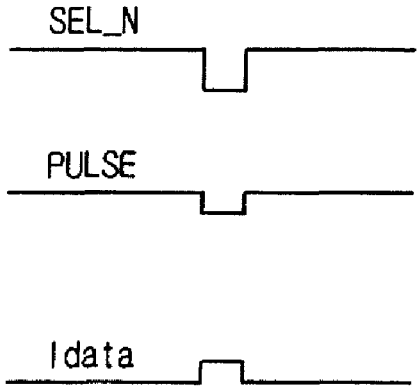
FIG. 6 is a timing diagram illustrating the unit pixel of FIG. 5.

FIG. 6 is a timing diagram illustrating the unit pixel of FIG. 5. As shown in FIG. 6, during operations of the unit pixel, when the third and fourth transistors T3 and T4 are turned on by a low select signal SEL_N supplied to the select signal line 11, the data current Idata supplied to the data line 13 flows in the first transistor T1 through the fourth transistor T4 and the second node B, thereby charging a drive voltage corresponding to the data current Idata in the gate of the first transistor T1, namely, the first node A. At this point, a difference value between the drive voltage and the pulse signal is stored in the capacitor Cst. Moreover, the gate and the source of the second transistor T2 are equipotential when the third transistor T3 is turned on, thereby turning off the second transistor T2. Accordingly, the data current Idata flowing in the first transistor T1 is supplied to the OLED by turning off second transistor T2.

When the select signal SEL_N is changed to a high state while the pixel select signal EM_N is changed to a low state, the third and the fourth transistors T3 and T4 are turned off. Thus, the drive current flows in the first transistor T1 by a voltage (a difference value between the drive voltage and the pulse signal) charged in the storage capacitor Cst, and then is supplied to the OLED to emit light. In this exemplary embodiment, since the third transistor T3 is turned off, an equipotential between the gate and the source of the second transistor T2 cannot be maintained. In other words, since a drive voltage charged in the first node, namely, the gate of the second transistor T2, is different from a voltage charged in the second node, namely, the source of the second transistor T2, there is an electric potential difference between the gate and the source of the second transistor T2. This electric potential difference is higher than a threshold voltage of the second transistor T2, thereby turning on the second transistor T2. Accordingly, the drive current flowing in the first transistor T1 is supplied to the OLED to emit light through the second transistor T2.

The drive current has a current value generated in proportion to a voltage charged in the storage capacitor Cst, and is almost identical to the data current Idata. However, when the pulse signal PULSE is changed, the voltage (a difference valued between the drive voltage and the pulse signal) charged in the storage capacitor Cst is also changed by the pulse signal PULSE. For example, when the pulse signal PULSE is changed from a low state to a high state, the drive voltage charged in the first node A increases as much as the increased pulse signal. The drive current flowing in the first transistor T1 becomes smaller than the data current Idata by the increased drive voltage. The brightness of the OLED decreases more by the drive current that is smaller than the data current Idata. Accordingly, a gray scale determined by the data current Idata can be changed by controlling the pulse signal PULSE, thereby easily expressing a low gray scale. In addition, a pulse width of the pulse signal PULSE may be designed differently according to a circuit configuration and a data line load.

Figure 7:
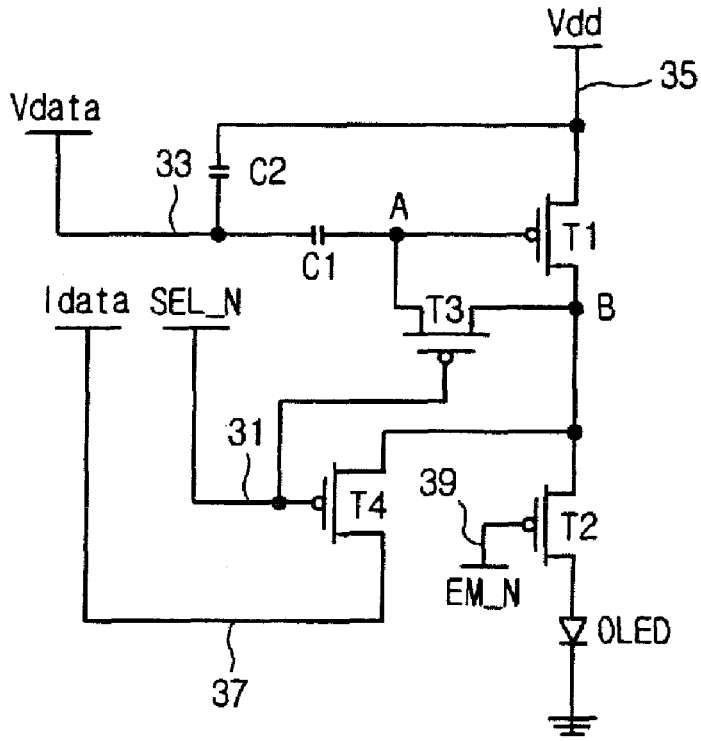
FIG. 7 is a circuit diagram illustrating a unit pixel according to a third exemplary embodiment of the present invention.

FIG. 7 is a circuit diagram of a unit pixel according to a third exemplary embodiment of the present invention. As illustrated in FIG. 7, the unit pixel includes a drive unit and an OLED connected to the drive unit. The drive unit further includes first to fourth transistors T1 to T4 and first and second capacitors C1 and C2. The first to fourth transistors T1 to T4 may be PMOS transistors that are turned on by a low signal, and turned off by a high signal. The first transistor T1 is a current drive transistor. The second to fourth transistors T2 to T4 are switching transistors. Also, the first to fourth transistors T1 to T4 may be NMOS transistors that are driven by a signal having a phase inversed to that of a signal supplied to a gate of the PMOS transistor.

In this exemplary embodiment, the unit pixel includes a hybrid structure combining a voltage drive and a current drive. The drive unit includes a first transistor T1 connected to a power voltage supply line 35, a second transistor T2 connected between the first transistor T1 and an OLED, and third and fourth transistors T3 and T4 connected to a select signal line 11 and a gate. Specifically, the first transistor T1 has its gate, drain and source connected to a first node A, a second node B and the power voltage supply line 35, respectively. The second transistor T2 has its gate, drain and source connected to a pixel select signal line 39, the OLED and the second node B, respectively. The third transistor T3 has its gate, drain and source connected to a select signal line 31, the second node B and the first node A, respectively. The fourth transistor T4 has its gate, drain and source of are connected to the select signal line 31, a first data line 37 and the second node B, respectively. Moreover, the first capacitor C1 is disposed between the first node A and the second data line 33. The second capacitor C2 is disposed between the power voltage supply line 35 and the second data line 33 to maintain a voltage charged in the first capacitor C1 during a predetermined interval.

Figure 8:
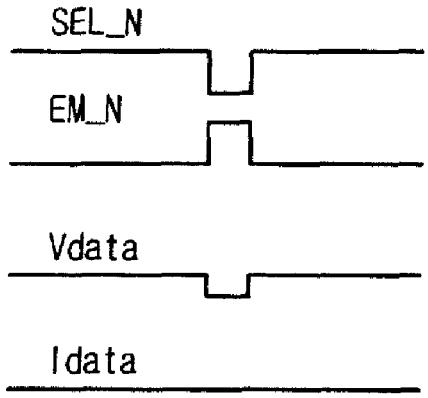
FIG. 8 is a timing diagram illustrating the unit pixel of FIG. 7.

FIG. 8 is a timing diagram illustrating the unit pixel of FIG. 7. As shown in FIG. 8, during operations of the unit pixel, when the third and fourth transistors T3 and T4 are turned on by a low select signal SEL_N supplied to a select signal line 31, the data current Idata supplied to the first data line 37 flows in the first transistor T1 through the fourth transistor T4 and the second node B, thereby charging a drive voltage corresponding to the data current Idata in the gate of the first transistor T1, namely, the first node A. At this point, a difference value between the drive voltage and the pulse signal is stored in the first capacitor C1. Here, the data voltage Vdata supplied to the second date line 33 may be a pre-charging voltage with a low state. Moreover, the gate and the source of the second transistor T2 are equipotential when the third transistor T3 is turned on, thereby turning off the second transistor T2. Accordingly, the data current Idata flowing in the first transistor T1 is cut off to the OLED by turning off second transistor T2. The data current Idata has a constant current level. That is, the data current is a predetermined and constant value.

When the select signal SEL_N is changed to a high state while the pixel select signal EM_N is changed to a low state, the third and the fourth transistors T3 and T4 are turned off. Thus, the drive current flows in the first transistor T1 by a voltage (a difference value between the drive voltage and the pulse signal) charged in the first capacitor C1, and then is supplied to the OLED to emit light. When the pixel select signal EM_N is a low state, the second transistor T2 is turned on, so that the drive current generated in the first transistor T2 is directly supplied to the OLED. At this point, the drive current has a current value proportional to a voltage charged in the first capacitor C1. This drive current is determined by a data voltage Vdata. That is, the drive voltage charged in the first node A is changed according to an amount of the data voltage Vdata, so that the drive current is generated differently in proportion to the changed drive voltage. The data voltage may be classified into a pre-charging voltage at the beginning, and an effective data voltage that is changed differently when driving. Accordingly, the pre-charging voltage, the effective data voltage and the data current Idata can be changed and designed according to the pixel structure and the data line load.

Figure 9:
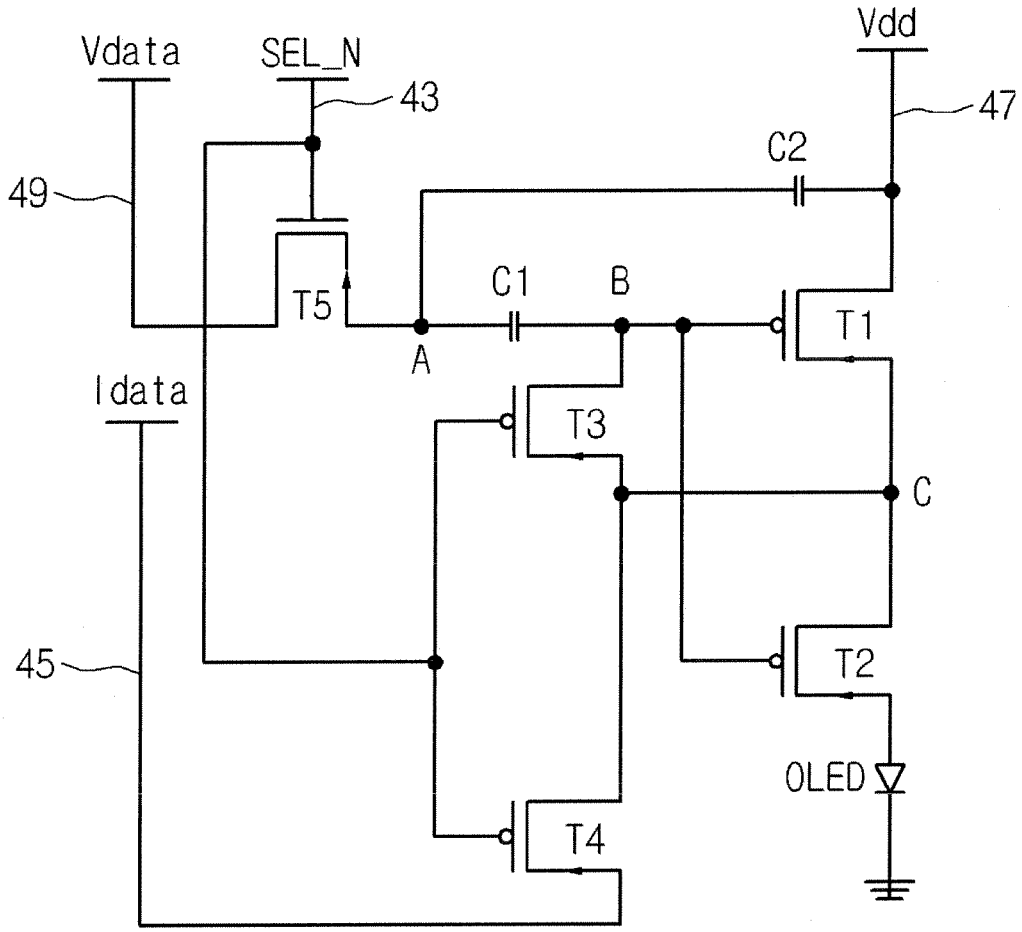
FIG. 9 is a circuit diagram illustrating a unit pixel according to a fourth exemplary embodiment of the present invention.
Figure 10:
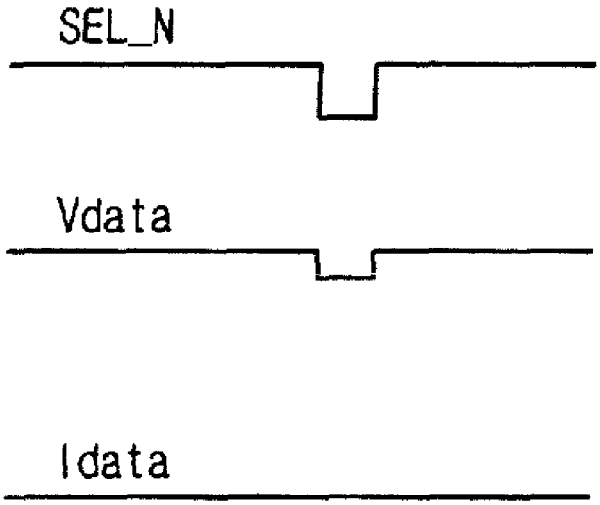
FIG. 10 is a timing diagram illustrating the unit pixel of FIG. 9.

FIG. 9 is a circuit diagram illustrating a unit pixel according to a fourth exemplary embodiment of the present invention. A detailed description for structure and driving similar to the previous exemplary embodiments will be omitted for conciseness. The fourth exemplary embodiment combines the second and third exemplary embodiments. That is, the fourth embodiment includes the first and second transistors T1 and T2 that have their gates connected to the first node A in the second exemplary embodiment, and a hybrid structure combining the current drive Idata and the voltage drive in the third exemplary embodiment.

In the fourth embodiment, a fifth transistor T5 is arranged between the first node A and a second data line 49, and the third to fifth transistors T3 to T5 have their gates connected to a select signal line 43. The first to fourth transistors T1 to T4 may be PMOS transistors. The fifth transistor T5 may be a NMOS transistor. Accordingly, the first to fourth transistors T1 to T4 are turned on by a low signal and turned off by a high signal. The fifth transistor T5 is turned on by a high signal and turned off by a low signal. On the other hand, all the first to fifth transistors T1 to T5 may be PMOS transistors or NMOS transistors. In this case, signals with a mutually opposite phase need to be supplied to the third and fourth transistors T3 and T4, and the fifth transistor T5, respectively. For example, when the high signal is supplied to the third and fourth transistors T3 and T4, the low signal is supplied to the fifth transistor T5.

The first transistor T1 has its gate, drain and source connected to the second node B, a third node C and a power voltage supply line 47, respectively. The second transistor T2 has its gate, drain and source connected to the second node B, the OLED and the third node C, respectively. The third transistor T3 has its gate, drain and source connected to the select signal line 43, the third node C and the second node B, respectively. The fourth transistor T4 has its gate, drain and source connected to the select signal line 43, the first data line 45 and the third node C, respectively. The fifth transistor T5 has its gate, drain and source connected to the select signal line 43, the first node A and the second data line, respectively. Moreover, the first capacitor C1 is disposed between the first node A and the second node B. The second capacitor C2 is disposed between a power voltage supply line 47 and the first node A.

A detailed description for fundamental operations of the unit pixel similar to the previous embodiments will be omitted for conciseness. In this fourth exemplary embodiment, when the third and fourth transistors T3 and T4 are turned on by the select signal SEL_N of a low state, the fifth transistor T5 is turned off. The data current Idata with a constant level flows in the first transistor T1 through the fourth transistor T4 and the third node C, and thus a drive voltage is charged in the gate of the first transistor T1, namely, the second node B, by the data current Idata. Since the fifth transistor T5 is turned off, no data voltage Vdata is supplied to the first node A. Accordingly, the drive voltage is charged in the first capacitor C1. Since an equipotential state is maintained between the gate and the source of the second transistor T2, the second transistor T2 is turned off, and the data current Idata flowing in the first transistor T1 is not supplied to the OLED.

When the third and fourth transistor T3 and T4 are turned off by the select signal SEL_N of a high state, the fifth transistor T5 is turned on. In this case, a predetermined electric potential difference is generated between the gate and the source of the second transistor T2, thereby turning on the second transistor T2. Moreover, when the fifth transistor T5 is turned on, the data voltage Vdata is supplied to the second data line 49. Thus, a drive voltage of the second node B is changed by the first capacitor C1, and a drive current of the first transistor T1 is also changed. The changed drive voltage is supplied to the OLED for emitting light through the second transistor T2.

Accordingly, by using the select signal line SEL_N, both the first transistor T1 and the second transistor T2 can be controlled. Therefore, additional pixel select signal line EM_N is unnecessary. Moreover, the fifth transistor T5 is disposed between the first node A and the second data line 49, and operates in opposition to the third and fourth transistor T3 and T4, thereby more accurately controlling the drive voltage. As a result, a gray scale can be expressed in more detail and a low gray scale can be expressed more easily.

According to the above-described exemplary embodiments of the present invention, a drive voltage can be controlled more accurately using a data voltage and a pulse signal after the drive voltage of a drive transistor is determined by the data current. Thus, a detailed and low gray scale can be expressed more easily, and also an image quality can be improved.

It will be apparent to those skilled in the art that various modifications and variations can be made in organic electro-luminescence device and method of driving the same of the present invention without departing from the spirit or scope of the invention. Thus, it is intended that the present invention cover the modifications and variations of this invention provided they come within the scope of the appended claims and their equivalents.

What is claimed is:

1. An organic electro-luminescence device comprising:

a drive unit including first to fifth transistors and a capacitor; and an organic light emitting diode (OLED) to emit light under control of the drive unit, wherein the first transistor has its gate, drain and source directly connected to a third node, a second node and a power voltage supply line, respectively;

the second transistor has its gate, source and drain directly connected to third node, the second node and the OLED, respectively;

the third transistor has its gate, drain and source directly connected to a select signal line, the second node and the third node, respectively;

the fourth transistor has its gate, drain and source directly connected to the select signal line, a first data line and the second node, respectively;

the fifth transistor has its gate, drain and source directly connected to the select signal line, a second data line and a first node, respectively, said second data line being different from said first data line; and the capacitor is directly connected to the first node and the third node.

2. The organic electro-luminescence device according to claim 1, wherein the second data line supplies a data voltage to the drain of the fifth transistor.

3. The organic electro-luminescence device according to claim 1, wherein the first data line supplies a data current to the drain of the fourth transistor.

4. The organic electro-luminescence device according to claim 1, wherein the fifth transistor has a polarity opposite to that of the third and fourth transistors.

* * * * *